US008155271B2

(12) United States Patent
Beyerlein et al.

(10) Patent No.: US 8,155,271 B2
(45) Date of Patent: Apr. 10, 2012

(54) POTENTIAL CONTROL FOR HIGH-VOLTAGE DEVICES

(75) Inventors: Walter Beyerlein, Bubenreuth (DE); Richard Eichhorn, Hirschaid Seigendorf (DE); Werner Kühnel, Uttenreuth (DE); Sabine Missel, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 835 days.

(21) Appl. No.: 12/167,824

(22) Filed: Jul. 3, 2008

(65) Prior Publication Data

US 2009/0039710 A1 Feb. 12, 2009

(30) Foreign Application Priority Data

Jul. 13, 2007 (DE) ..... 10 2007 032 808

(51) Int. Cl.
*H05G 1/12* (2006.01)

(52) U.S. Cl. ..... 378/104; 307/91

(58) Field of Classification Search ..... 315/3, 32; 378/101, 104; 363/67, 71; 307/91; 439/930, 439/954

See application file for complete search history.

(56) References Cited

U.S. PATENT DOCUMENTS

| | | | | |
|---|---|---|---|---|
| 4,725,938 | A * | 2/1988 | Onodera | 363/28 |
| 5,023,768 | A * | 6/1991 | Collier | 363/68 |
| 5,191,517 | A * | 3/1993 | Stephenson | 363/59 |
| 5,257,304 | A * | 10/1993 | Sireul et al. | 378/101 |
| 5,602,897 | A * | 2/1997 | Kociecki et al. | 378/101 |
| 2007/0291903 | A1 * | 12/2007 | Canfield | 378/194 |

FOREIGN PATENT DOCUMENTS

| | | |
|---|---|---|
| DE | 26 26 588 | 12/1977 |
| DE | 102 27 841 | 1/2004 |
| EP | 0 475 429 A2 | 3/1992 |
| EP | 1 696 517 A1 | 8/2006 |

OTHER PUBLICATIONS

German Office Action dated Apr. 23, 2008 with English translation.

* cited by examiner

*Primary Examiner* — Thuy Vinh Tran

(74) *Attorney, Agent, or Firm* — Lempia Summerfield Katz LLC

(57) ABSTRACT

The present embodiments related to a device having a device element to which a high voltage can be applied. The device is provided with at least one additional conducting element which is disposed, embodied and connected in such a way that the element is assigned a defined potential value and a change to the electric field generated by the high voltage in the sense of a more favorable field distribution is effected by means of position, shape and potential value. According to the invention, maximum loads on switching elements are avoided and undesirable phenomena such as voltage breakdowns or flow voltages are counteracted as a result of the more favorable field distribution.

18 Claims, 9 Drawing Sheets

Polarity for reverse bias

POTENTIAL CONTROL FOR HIGH-VOLTAGE DEVICES

This application claims the benefit of DE 10 2007 032 808.9 filed Jul. 13, 2007, which is hereby incorporated by reference.

BACKGROUND

The present embodiments relate a device element to which a reference voltage is applied.

High voltages (e.g., voltages that typically lie in the 50-150 kV range) are used for power transmission and for producing a variety of technical and physical effects, such as, for generating X-radiation, electric arcs, in cathode ray tubes, ignition coils, or for fluorescent lighting. A precisely adjusted high voltage (e.g., in the form of direct-current voltage) is required for generating electric fields, e.g. in order to accelerate or deflect electrons or other elementary particles. Precision high-voltage power supplies are used for generating the high voltage. DE 10227841 discloses a high-voltage power supply that generates a direct-current voltage for an X-ray tube. An intermediate circuit direct-current voltage is obtained from an input voltage by the direct-current high-voltage power supply. The intermediate circuit direct-current voltage is converted into an alternating-current voltage. The alternating-current voltage is transformed into a high voltage, which is rectified.

When X-rays are generated, the high voltage is used to accelerate electrons emitted by a cathode. X-rays are produced as the electrons strike the anode and are decelerated by the anode (discrete X-radiation or continuous-spectrum (bremsstrahlung) radiation).

The use of high voltage leads to an increased load being imposed on the switching elements used. In order to prevent damage to the switching elements and avoid undesirable effects, such as voltage breakdowns, the load on the switching elements should be kept to a minimum.

SUMMARY AND DESCRIPTION

The present embodiments may obviate one or more of the drawbacks or limitations inherent in the related art. For example, one embodiment may improve the fault resilience and operation of high-voltage systems.

The loads induced by a high voltage in a high-voltage system, such as an X-ray generator, may be reduced by controlling changes to the electric field or to the potential distribution. Controlled changes are performed by one or more additional conductive elements (also referred to in the exemplary embodiment as control electrodes). The term "additional" in this context is to be understood as meaning that functionally such an additional element essentially serves only for the purpose of controlling the electric field. The additional element may be disposed, embodied, and connected in circuitry terms in such a way that it is assigned a defined potential value (e.g., the value of the high voltage or of the reference voltage, half the value of the high voltage or some other fraction of the high voltage which is easy to implement in circuitry) and that a change to the electric field generated by the high voltage in the sense of a more favorable field distribution will be effected by (based on) position, shape, and potential value. A more favorable field distribution may be a field distribution in which the imposing of maximum loads on switching elements is avoided or undesirable phenomena such as voltage breakdowns or flow voltages are counteracted.

In one embodiment, maximum loadings of device elements, such as switching elements or carriers, to which high voltage is applied during operation may be reduced. A compact design may provide a uniform distribution of the field strength.

In a first embodiment, a device element, which is exposed to high voltages and in which the load can be varied to achieve a more uniform loading, is a high-voltage rectifier. A high-voltage rectifier may include an array of diodes connected in series (e.g., a diode chain). The frontmost diode may be the one exposed to the highest loads. The loading is encompassed in by two conductive or conducting plates. The plates may be arranged transversely with respect to the diode chain in such a way that the potential value of one of the plates is equal to or greater than the potential value of the output of the diode chain and the potential value of the other plate is equal to or less than that of the input of the diode chain.

In a second embodiment, the maximum values of the electric field strength may be reduced in proximity to a device element to which high voltage is applied during operation of the device. Position, shape, and potential value of the at least one additional conducting element are determined or specified in such a way that a reduction in the field strength of the electric field induced by the high voltage is effected in proximity to the device element. The potential value of the at least one additional conducting element may be between the value of the high voltage and the value of the reference potential, for example, half of the high-voltage value. The device element is, for example, a wire by which the cathode voltage of an X-ray device is applied. The additional conducting element may surround the wire so that the field is reduced on all sides. A plurality of device elements (e.g., usually all device elements if possible) may be combined at high voltage, where the physical conditions permit, and essentially (to the extent that this is constructionally possible) enclose the plurality of device elements with the additional conducting element or a control electrode in a cage.

In a third embodiment, a high-voltage connector system generates a uniform field distribution in the vicinity of the connector system by the position, shape and potential value of the device element. In order to achieve a more uniform field distribution, a plurality of additional conducting elements, some of which are at high voltage and some of which are at reference potential may be used. Some of the plurality of additional conducting elements may be disposed on a connector and some on a connector receptacle representing the counterpart to the connector.

DETAILED DESCRIPTION

Figure 1:
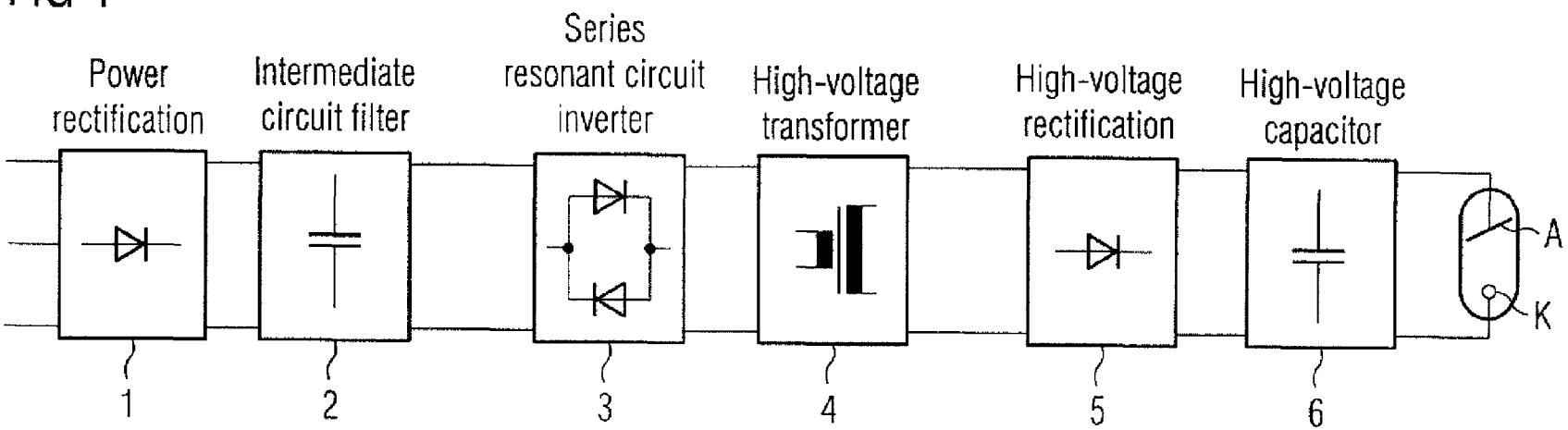
FIG. 1 shows an X-ray generator implemented in inverter technology.

FIG. 1 shows a schematic circuit diagram of an X-ray generator implemented in inverter technology. The voltage applied to the X-ray tube 7 between anode A and cathode K is a direct-current voltage. The direct-current voltage may be obtained by a power rectifier 1 and an intermediate circuit filter 2. The direct-current voltage may be converted into an alternating-current voltage by a series resonant circuit inverter 3. The alternating-current voltage may be transformed by a high-voltage transformer 4 into a high voltage, which is converted into a direct-current voltage, for the X-ray tube 7 by a high-voltage rectifier 5 and filtered by a high-voltage capacitor 6.

Figure 2:
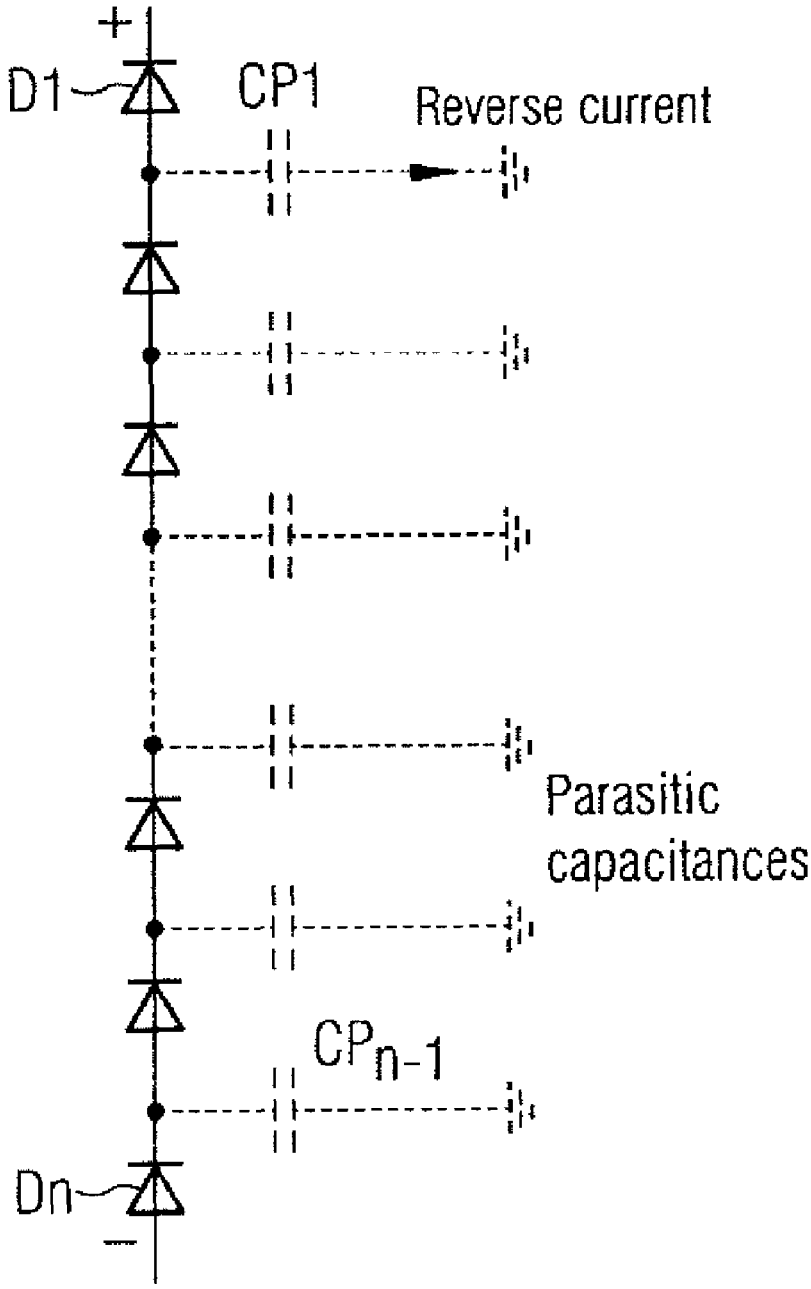
FIG. 2 shows a chain of high-voltage diodes connected in series.

The high voltage at the X-ray tube 7 may be 75 kV and more relative to ground or reference potential. As shown in FIG. 2, the high-voltage rectifier 6 is assembled from an array of commercially available high-voltage diodes connected in series. FIG. 2 illustrates a diode chain (diodes D1 . . . Dn) of a high-voltage rectifier.

The polarity of the high voltage originating from the high-voltage transformer may be such that the high-voltage diodes are in the conducting state. If the polarity of the applied high voltage changes, the high-voltage diodes transition to the cut-off state. However, the transition to the cut-off state does not take place arbitrarily quickly, since the minority charge carriers contained in the depletion layer of the high-voltage diodes are first eliminated. During this time interval, a reverse voltage is present at the diodes. Because current continues to flow through the diodes due to the charge carriers present, a high power loss, referred to as the turn-off loss, occurs momentarily. Particularly in the case of X-ray generators which operate in the higher frequency range, the high-voltage diodes may be subject to a heavy load due to the turn-off losses.

FIG. 2 shows parasitic capacitors or parasitic capacitances (CP1 . . . $CP_{n-1}$). During the transition from the conducting (forward-biased) to the non-conducting (reverse-biased) state, the topmost partial capacitance CP1 is charged up first and then the other partial capacitances in turn. Accordingly, almost all of the externally applied voltage is present initially at the topmost high-voltage diode, until the other partial capacitances are then charged up in turn. Particularly high turn-off power losses occur at the topmost high-voltage diode and then at the other upper high-voltage diodes.

High-voltage diodes having "controlled-avalanche characteristics," which are able to withstand these high peak loads, may be used. To reduce the heavy load on the upper partial capacitances and prevent malfunctions in these switching elements, a potential control is provided to allow the turn-off power losses to be distributed uniformly over all of the high-voltage diodes.

Figure 3:
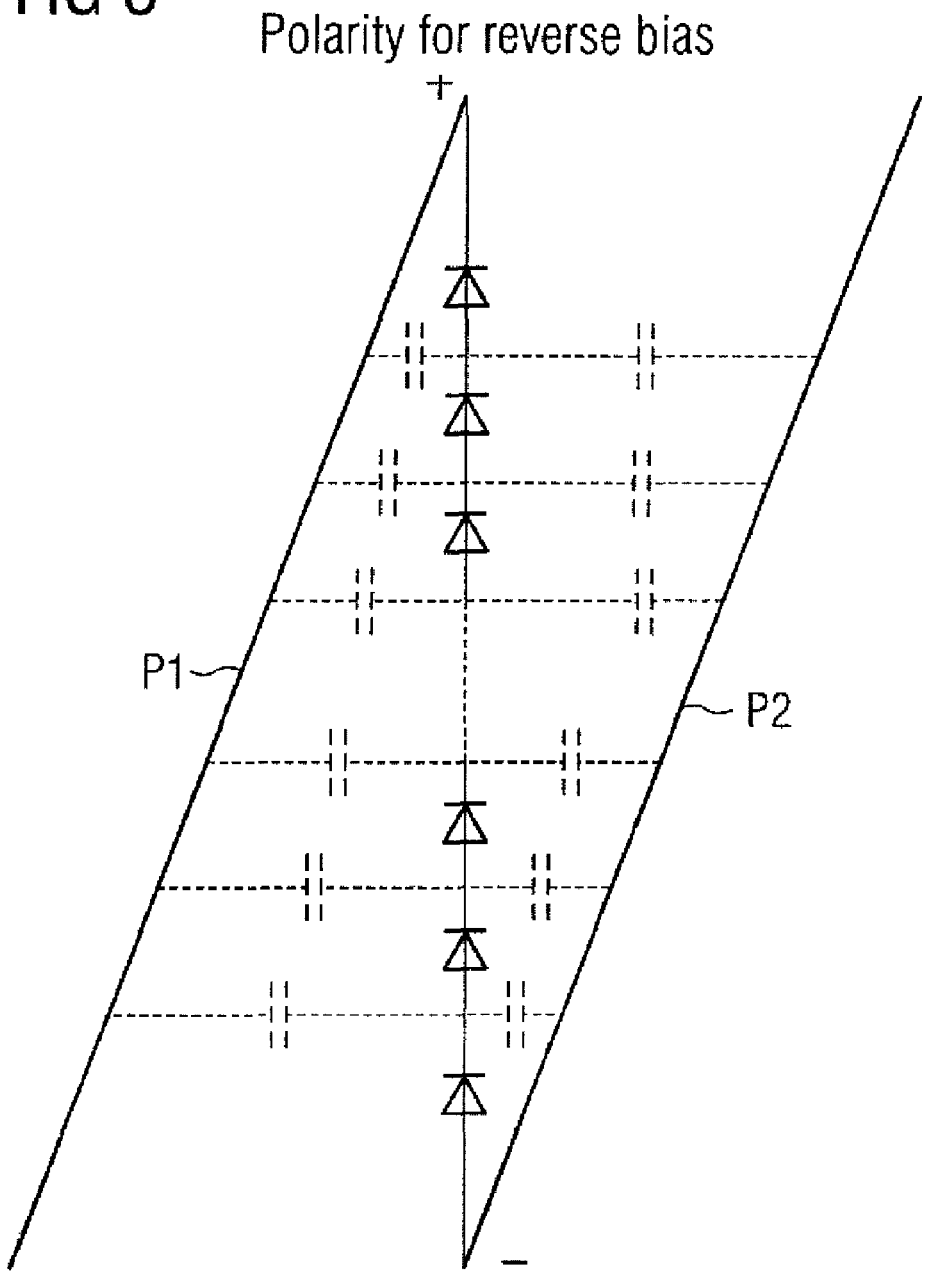
FIG. 3 shows potential control of a high-voltage diode chain.

The potential control may include a diode chain that is embedded between two transversely mounted conductive plates P1 and P2, of which one (P1) is connected to the potential of the top diode and the other (P2) to the potential of the bottom diode. The electric field between the diode chain and the plates may lead to the formation of spatially distributed capacitances, which are represented by dashed lines in FIG. 3. The distributed capacitances may be capacitances per unit length. Such a capacitance per unit length may increase the closer the plate is to the resistance. Accordingly, a capacitive voltage divider corresponding to the partial ratio at the diode chain is located at each point of the diode chain. The dynamic voltage distribution at the diodes is roughly equal to the total voltage divided by the number of diodes. During the transition from the conducting to the non-conducting state there results a uniform voltage distribution controlled by the capacitances, which ensures that the turn-off losses are distributed virtually uniformly over all of the diodes.

Figure 4:
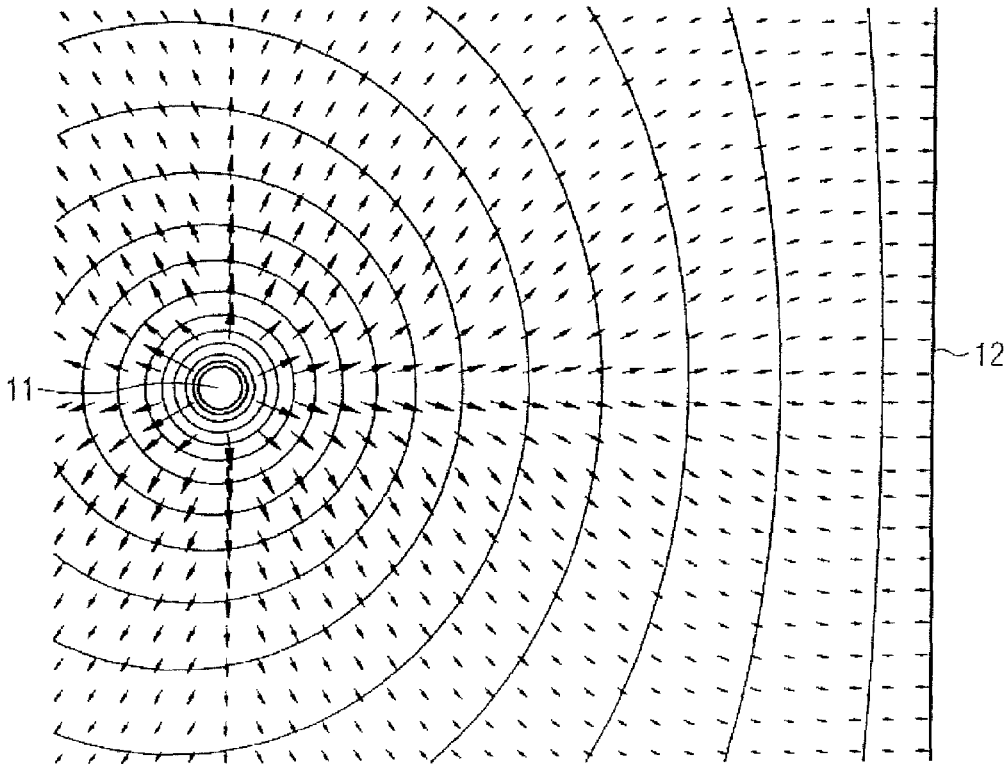
FIG. 4 shows a change in the electrical potential on a line which is at high-voltage potential.
Figure 5:
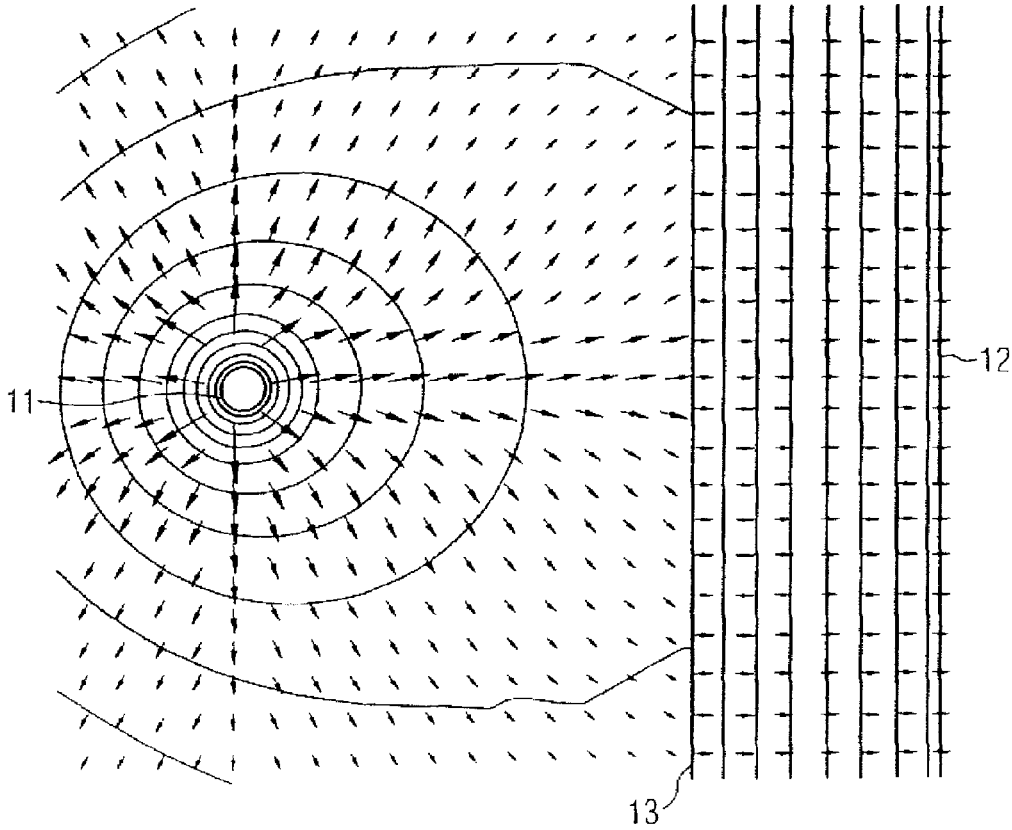
FIG. 5 shows a reduction in the change in potential in proximity to a line at high-voltage potential by an intermediate electrode.

In one embodiment, as shown in FIGS. 4 and 5, an intermediate electrode may lie at a partial voltage.

In high-voltage generators of X-ray generators, the X-ray tube voltage may be disposed symmetrically relative to the reference potential. Accordingly, the assemblies, including the high-voltage cables, may have high-voltage insulation.

In one embodiment, high voltage may be disposed unilaterally relative to the reference potential. Accordingly, high-voltage insulation is difficult to ensure. FIG. 4 shows lines that are connected to the potential of the total voltage. As shown in FIG. 4, a wire 11 has a thickness of 7 mm. The wire 11 lies at a potential of 150 kV. An edge or a limit of the X-ray device 12 is shown. The edge lies at reference potential. The distance between the wire 11 and the edge 12 is 100 mm. Potential lines are drawn in the figure at intervals of 10 kV. The density of the potential lines is a measure for the field strength. The field strength is at its highest close to the wire 11, where it amounts to max 9 kV/mm.

The peak effect of the electric field strength may cause excessive field strengths at the lines lying at high-voltage potential, such as, for example, wire 11, which have a relatively small diameter compared to the other dimensions. Excessive field strengths may be field strength values, which due to their size, are a hazard potential (e.g. spark formation or corona discharges, voltage breakdowns). To reduce the high field strength to harmless values, a great distance between the lines and the reference potential may be required. Accordingly, a disproportionately great distance would be necessary, since the distance is included in the high field strength at the small radii only via its logarithm. The high field strengths may be beneficially reduced by way of a greater diameter of the lines, which in turn gives rise to production problems, since lines with a large diameter are unwieldy to install and in addition—since they are to be provided with a high-voltage insulation—are not widely established components.

In one embodiment, an intermediate electrode 13 is used. A voltage between the reference potential and the total voltage is applied to the intermediate electrode 13. The voltage between the reference potential and the total voltage may be half the total voltage, which may be available due to the circuit layout (FIG. 5).

FIG. 5 shows a wire 11. The wire 11 may have a thickness of 7 mm, which is at a potential of 150 kV. To reduce the field strength, an intermediate electrode 13 may be provided. The intermediate electrode 13 may lie at 75 kV. The edge 13 may lie at reference potential. The distance between the wire 11 and the edge 12 may be 100 mm. As a result of the intermediate electrode 13, the maximum field strength is reduced to 6 kV/mm. This is also apparent from the potential lines which have a distance of 10 kV. The field strength between the reference electrode and the intermediate electrode amounts to 2 kV/mm.

For example, the measure of the intermediate electrode 13 may reduce field strength excess at the tight radii of the equipotential lines. The intermediate electrode 13 may enclose the components, which lie at the total voltage, like an electric cage, insofar as this is constructionally possible.

Instead of using one control electrode, a potential control may be implemented by a plurality of control electrodes, which lie, for example, at different partial potentials.

In FIGS. 6 to 9 illustrate potential control used in conjunction with a high-voltage connector.

The high-voltage connector may present a particular problem in the case of high voltage. A high-voltage connector is shown in FIG. 6.

A connector 31 (horizontally hatched area) may be introduced into a receptacle 32 (diagonally hatched area), such that a contact is established. An internal conductor 33 of the connector 31 is indicated to illustrate the contacting. A narrow air gap 34 remains between connector 31 and receptacle 32 after the two parts are connected.

The casting material from which connector 31 and receptacle 32 are made is loaded to breakdown. Although the casting material may not present a problem (provided the casting process has been performed cleanly and free of voids, i.e., without holes), the leakage current load in the air gap between connector and receptacle may cause a problem. The leakage current resistance of high-voltage installations is inherently lower than the dielectric strength. It is essential to ensure a homogeneous distribution of the electric field strength along the leakage path. If excessive field strengths occur locally, this may lead to limited discharge processes at these points. The limited discharge processes at these points may damage the surface of the insulation material and over the long term result in a flashover along the leakage path.

Figure 6:
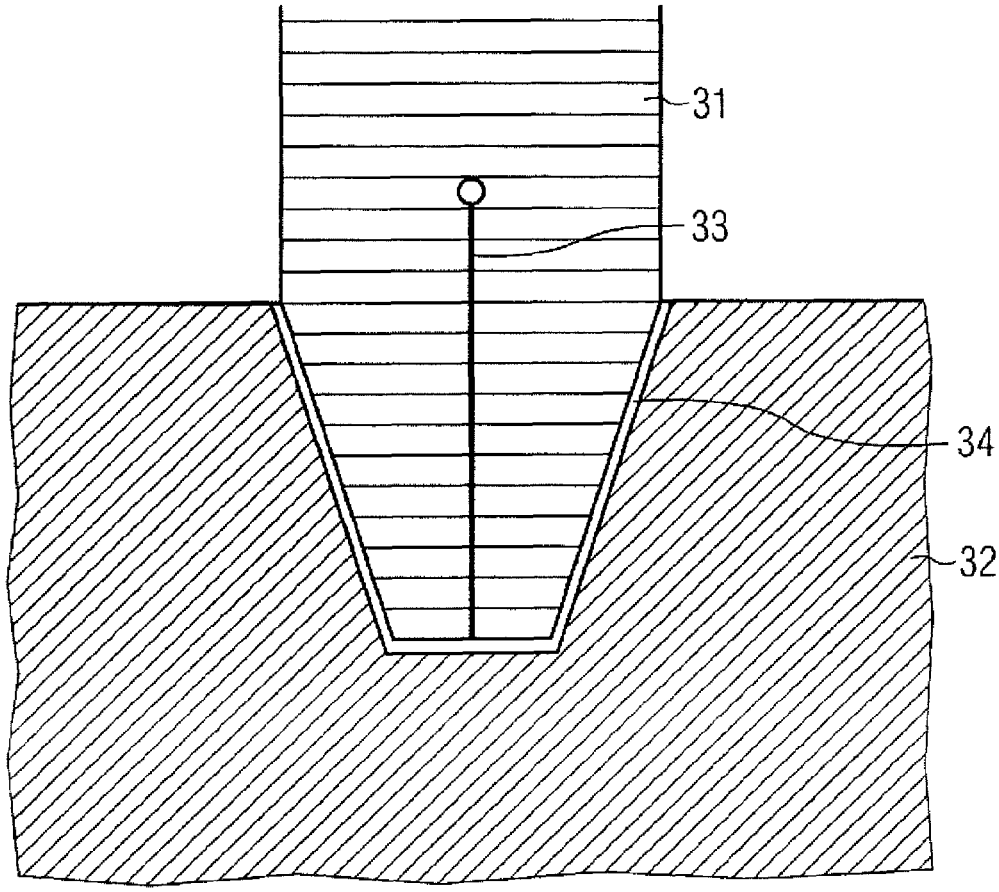
FIG. 6 shows the principle of a high-voltage connector.
Figure 7:
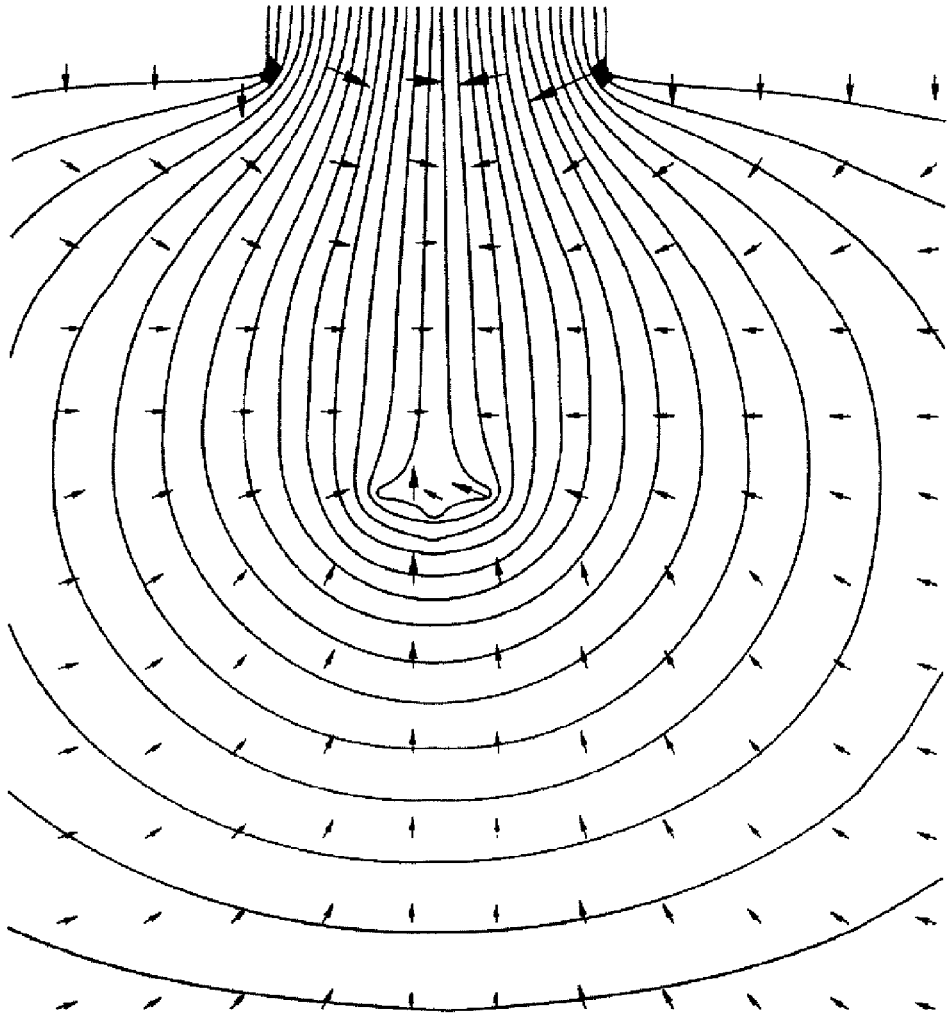
FIG. 7 shows the field distribution in the high-voltage connector system.

A simple connector is shown in FIG. 6. If the simple connector is used, then excessive field strengths may occur along the leakage path at the upper part of the air gap, as is shown by the simulation result of the field distribution in the high-voltage connector system shown in FIG. 7.

A long connector and/or additional insulation materials (e.g. silicone stocking) may be disposed in the air gap.

Control electrodes may be used to achieve a uniform field distribution along the air gap between high-voltage connector and receptacle to prevent the breakdown mechanism.

For example, four control electrodes or control elements 36, 39 having defined potential may be used. In this scheme the control electrode 36 and the control rings 37 and 38 lie at reference potential. The control element 39 lies at high-voltage potential.

The control electrode 36 may effect a capacitive voltage division between itself, the air gap, and the internal conductor 31. The voltage along the air gap 34 may be uniformly reduced. The principle of operation corresponds to that of FIG. 3.

In one embodiment, the optimal characteristics of the control electrode may be as long as the high-voltage connector and may have a shape similar to that of a spherical cap. However, simulation tests have shown that results that are only marginally less good are achieved using the variant shown in FIG. 8, which is easier to produce.

The control rings 37 and 38 effect a field harmonization at the top and bottom edges and contribute to a more uniform field distribution.

Figure 8:
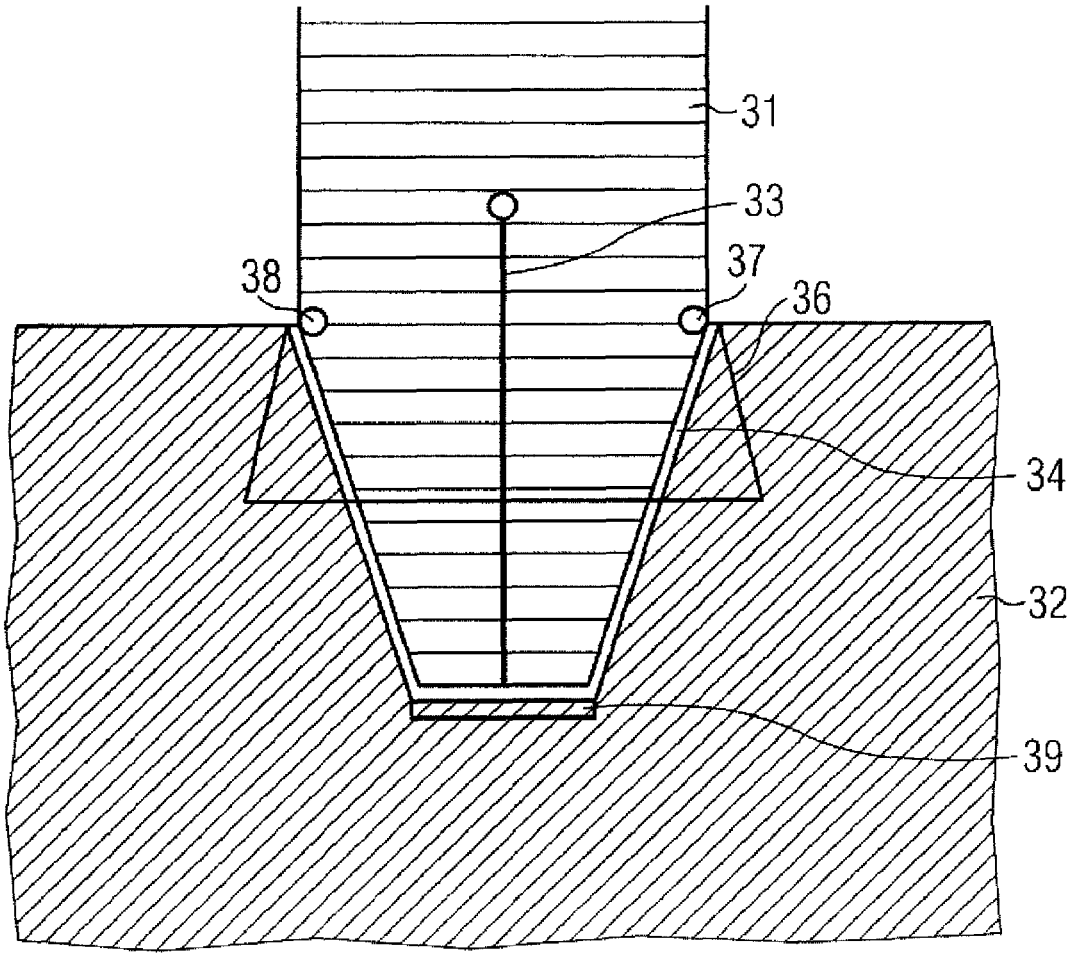
FIG. 8 shows a high-voltage connector with control electrodes.
Figure 9:
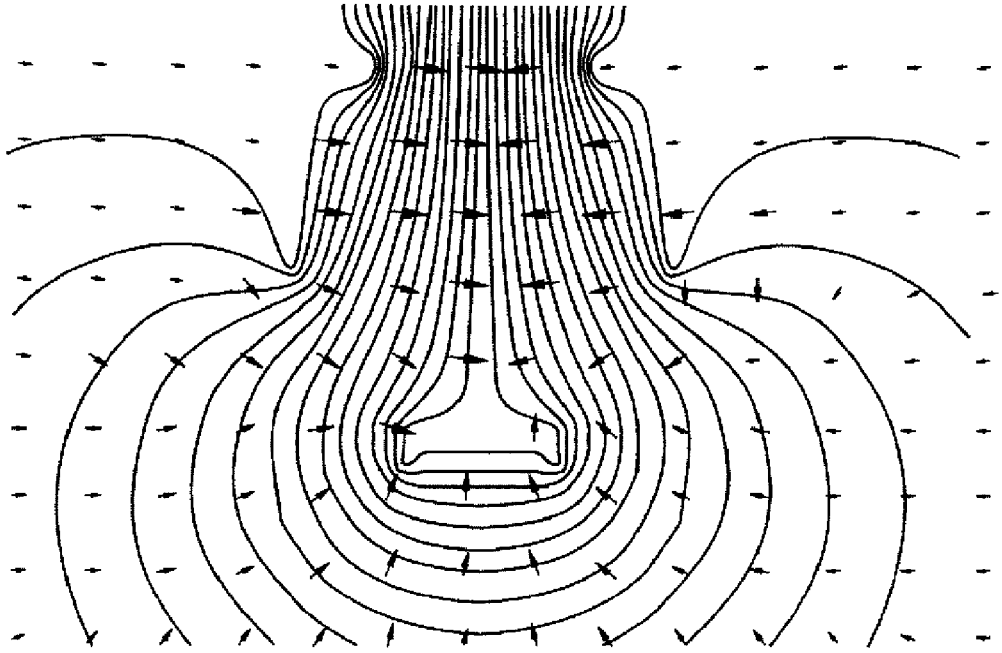
FIG. 9 shows the field distribution in the high-voltage connector system with field control by control electrodes.

Simulation results for the connector system from FIG. 8 are shown in FIG. 9. The field distribution in the high-voltage connector system may be homogenized by the field control. The uniform field distribution achieves a constant field strength within the air gap. Accordingly, it is possible to operate with higher voltages without undesirable leakage currents occurring.

The invention claimed is:

1. A device comprising:

a device element, to which a voltage is applied; and at least one conducting element that is disposed and connected to the device element such that the at least one conducting element has a defined potential value, wherein a position, a shape, and the defined potential value of the at least one conducting element change an electric field generated by the applied voltage to provide a field distribution, wherein the field distribution is a uniform field distribution in the vicinity of the at least one conducting element.

2. The device as claimed in claim 1, wherein the device element comprises a high-voltage rectifier comprising a diode chain and two conducting plates, the two conducting plates being arranged transversely with respect to the diode chain and contacting the diode chain such that a potential value of one conducting plate of the two conducting plates is equal to or greater than a potential value of an output of the diode chain, and a potential value of the other conducting plate of the two conducting plates is equal to or less than a potential value of an input of the diode chain.

3. The device as claimed in claim 2, wherein the conducting plate having the higher potential value is conductively connected to an output of the high-voltage rectifier, and the conducting plate having the lower potential value is conductively connected to an input of the high-voltage rectifier.

4. The device as claimed in claim 1, wherein the position, the shape and the defined potential value of the at least one conducting element are determined such that a reduction in field strength of the electric field generated by the applied voltage is effected in proximity to the device element.

5. The device as claimed in claim 4, wherein the defined potential value of the at least one conducting element is between the value of the applied voltage and the value of a reference potential.

6. The device as claimed in claim 5, wherein the defined potential value of the at least one conducting element is half the value of the applied voltage.

7. The device as claimed in claim 4, wherein the device element is a wire.

8. The device as claimed in claim 4, wherein the at least one conducting element encloses the device element or a plurality of device elements, to which the voltage is applied, the plurality of device elements comprising the device element.

9. The device as claimed in claim 8, wherein the at least one conducting element is an electrical cage.

10. The device as claimed in claim 1, wherein the device element is part of a high-voltage connector system, and the position, the shape, and the defined potential value of the at least one conducting element provide a uniform field distribution in the vicinity of the high-voltage connector system.

11. The device as claimed in claim 10, wherein the at least one conducting element comprises a plurality of conducting elements, and wherein some conducting elements of the plurality of conducting elements are at high voltage, and some conducting elements of the plurality of conducting elements are at reference potential.

12. The device as claimed in claim 10, wherein the high-voltage connector system comprises a connector and a connector receptacle forming a counterpart to the connector, the connector and the connector receptacle including the at least one conducting element.

13. The device as claimed in claim 12, wherein the at least one conducting element comprises a plurality of conducting elements, and wherein two conducting elements of the plurality of conducting elements are control rings that are at reference potential and are disposed on the connector.

14. The device as claimed in claim 13, wherein two other conducting elements of the plurality of conducting elements are disposed on the connector receptacle, one conducting element of the two other conducting elements being at high voltage and the other conducting element of the two other conducting elements being at the reference potential.

15. The device as claimed in claim 1, wherein the device element is a wire.

16. The device as claimed in claim 1, wherein the device element is a connector.

17. A device comprising:

a device element, to which a voltage is applied; and at least one conducting element, which is disposed and connected to the device element such that the at least one conducting element has a defined potential value, wherein the device element comprises a high-voltage rectifier comprising a diode chain and two conducting plates, the two conducting plates being arranged transversely with respect to the diode chain and contacting the diode chain such that a potential value of one conducting plate of the two conducting plates is equal to or greater than a potential value of an output of the diode chain, and a potential value of the other conducting plate is equal to or less than a potential value of an input of the diode chain, wherein a position, a shape, and the defined potential value of the at least one conducting element change an electric field generated by the applied voltage to provide a field distribution.

18. A device comprising:

a device element, to which a voltage is applied; and at least one conducting element, which is disposed and connected to the device element such that the at least one conducting element has a defined potential value, wherein a position, a shape, and the defined potential value of the at least one conducting element change an electric field generated by the applied voltage to provide a field distribution, and wherein the device element is part of a high-voltage connector system, and the position, the shape, and the defined potential value of the at least one conducting element provide a uniform field distribution in the vicinity of the high-voltage connector system.

* * * * *